United States Patent [19]

Focke et al.

[11] Patent Number: 4,838,846

[45] Date of Patent: Jun. 13, 1989

[54] APPARATUS FOR COATING GLUE ONTO PACKAGING BLANKS

[75] Inventors: Heinz Focke, Verden; Wolfgang Oertel, Kirchlinteln, both of Fed. Rep. of Germany

[73] Assignee: Focke & Co., Verden, Fed. Rep. of Germany

[21] Appl. No.: 139,511

[22] Filed: Dec. 30, 1987

[30] Foreign Application Priority Data

Jan. 20, 1987 [DE] Fed. Rep. of Germany ..... 3701427

[51] Int. Cl.[4] ..... B31B 3/62; B31B 3/32

[52] U.S. Cl. ..... 493/132; 493/164; 493/278; 493/284; 493/336; 63/234; 63/383; 63/575

[58] Field of Search ..... 493/128, 130, 131, 132, 493/150, 151, 164, 183, 278, 284, 285, 331, 336, 337; 53/234, 383, 575

[56] References Cited

U.S. PATENT DOCUMENTS

| | | | |
|---|---|---|---|
| 1,338,749 | 5/1920 | Robinson | 493/164 |
| 1,976,980 | 10/1934 | Bergstein | 493/132 |
| 2,438,788 | 3/1948 | Palmer | 493/151 |
| 3,978,639 | 9/1976 | Ferozzi | 493/164 |
| 4,285,680 | 8/1981 | Randles | 493/132 |

*Primary Examiner*—Frederick R. Schmidt
*Assistant Examiner*—William E. Terrell
*Attorney, Agent, or Firm*—Sughrue, Mion, Zinn, Macpeak and Seas

[57] ABSTRACT

In the production of cigarette packs, especially soft-cup packs 11, folding tabs have to be provided with glue marks 15. To make accurate glue marks 15 even on packaging machines operating at a high working speed, a glue unit 16 is arranged on the periphery of the folding turret 35 in such a way that glue faces 32 of the glue-coating member 21 having glue wings 22, 23 come up against a side-wall tab 13 to be provided with glue marks 15, this at the same time being deformed elastically. As result of the relative movement, the glue wing 22, 23 is rolled on the side-wall tab 13 by means of the glue face 32, thus producing an accurate glue pattern.

4 Claims, 4 Drawing Sheets

APPARATUS FOR COATING GLUE ONTO PACKAGING BLANKS

BACKGROUND OF THE INVENTION

The invention relates to an apparatus for coating glue onto parts of packaging blanks, especially folding tabs, with a rotating glue-coating member which transfers glue portions extracted from a glue vessel onto the packaging blank.

In many packs, folding tabs have to be joined to one another by means of adhesive bonding. To provide glue spots on the folding tabs, the particular packaging machines are equipped with glue units which themselves have moveable glue-coating members for transferring the glue spots onto the folding tabs. In high-performance packaging machines, especially for producing cigarette packs, the glue units have to be of correspondingly high performance, but must nevertheless be capable of producing accurate glue spots with an exactly metered quantity of glue.

SUMMARY OF THE INVENTION

The object on which the invention is based is to provide a glue unit which is suitable for particularly high-performance packaging machines, for example for producing soft-cup cigarette packs.

To meet these requirements, the glue unit according to the invention is characterized in that the glue-coating member is moveable up against the freely projecting, elastically deformable folding tab and can roll on this by means of a glue face, at the same time pivoting the folding tab elastically.

Transferring the glue portions onto an elastically deformable, that is to say unsupported region of the blank makes it possible to achieve higher working speeds, whilst preserving the exact metering of the quantity of glue and an accurate design of the glue contours or glue faces. The invention can be used in an especially advantageous way in conjunction with a continuously rotating folding turret for receiving the (cigarette) packs in radially outer open pockets. In this case, the glue-coating device or glue-coating member is arranged adjacent to the outer periphery of the folding turret, in such a way that the rotating glue-coating member enters the path of movement of the folding turret and of the rearward-projecting folding tab to be provided with glue. The movements of the rotary-driven glue-coating member and of the likewise rotating folding turret are coordinated with one another in such a way that momentarily there is synchronism, during which the transfer of glue onto the folding tab is completed. Because the rotary movement briefly occurs in the same direction, despite the high rotational speed of the folding turret there is sufficient time available to make accurate glue spots.

The glue-coating member preferably consists of several, especially two radially directed glue wings which are attached to a drive shaft driven to rotate.

Further features of the invention relate to the design of the glue unit. An exemplary embodiment is explained in detail below with reference to the drawings.

DESCRIPTION OF A PREFERRED EMBODIMENT

Figure 1:
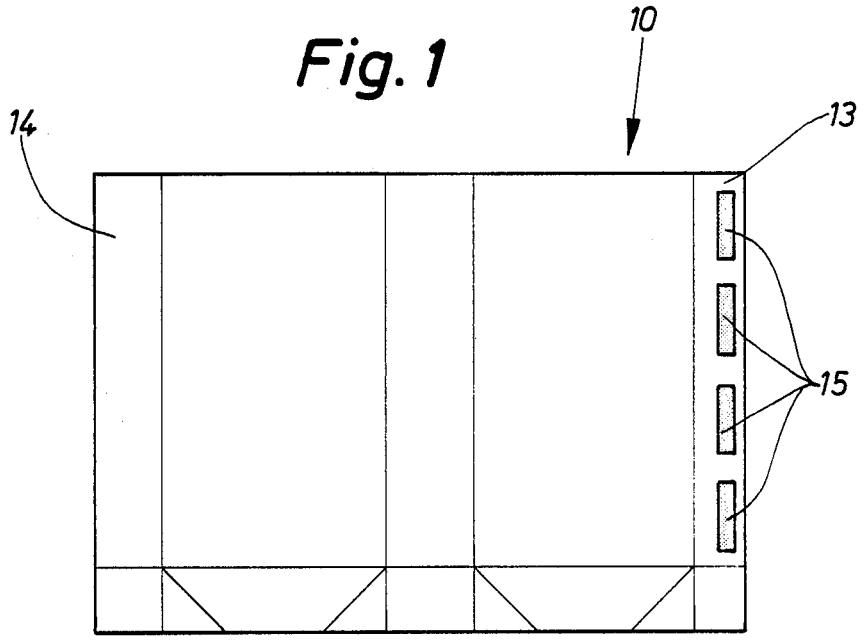
FIG. 1 shows a spread-out blank of a (cigarette) pack with glue spots.
Figure 2:
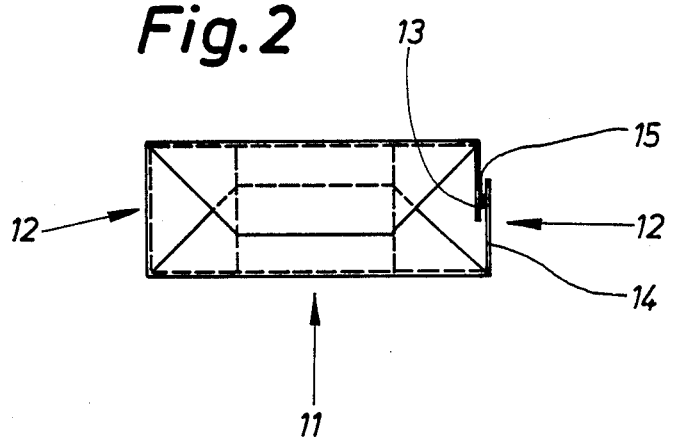
FIG. 2 shows a bottom view of a pack folded from a blank according to FIG. 1.

The preferred exemplary embodiment illustrated in the drawings is concerned with the glue-coating of a blank 10 for a soft-cup cigarette pack 11. A soft-cup pack 11 of this type is conventionally designed so that, in the region of a narrow side-wall 12, the blank forms a tubular overlap composed of two side-wall tabs 13, 14 partially covering one another. These are joined together by means of glue in the region of the approximately central overlap. In the procedure adopted for the present exemplary embodiment, glue is coated onto the outer face of the side-wall tab 13 which is the inner after folding, before the two side-wall tabs 13 and 14 are folded into the position shown in FIG. 2.

The glue is applied to the side-wall tab 13 in individual glue marks 15 delimited from one another. In the present exemplary embodiment, four glue marks 15 altogether are distributed over the length of the side-wall tab 13 and are arranged at a distance from another. Before the side-wall tabs 13 and 14 are joined to one another, the glue marks 15 have a rectangular elongate shape.

The glue or the glue marks 15 are coated onto the blank 10 by means of a glue unit 16. The glue unit 16 consists of a closed glue vessel 17 with a glue stock 18. A metered glue layer is extracted continuously from this by means of a glue roller 19 which is mounted, driven to rotate, inside the glue vessel 17. A stripper 20 meters the glue layer on the circumference of the glue roller 19.

Arranged outside the glue vessel 17 is a glue-coating member 21. Here, this consists of two glue wings 22, 23 which extend in the same plane and which are arranged so as to project radially on a common drive shaft 24. This, in turn, is mounted rotatably in lateral retainers 25 as an extension of the glue vessel 17. An extension of the drive shaft 24 which passes through the retainer 25 is driven to rotate by means of a toothed-belt drive 27. This, in turn, is connected to a main shaft 28 serving for driving the glue roller. The glue vessel 17 is divided approximately centrally (dividing plane 29). Access to the members located inside the glue vessel 17 is obtained by removing the upper part of the latter.

One side wall 30 of the glue vessel 17 is provided with a perforation 31. The glue roller 19 rotates immediately adjacent to this. The glue-coating member 21 passes with the glue wings 22, 23 through the perforation 31 up to contact with the circumference of the glue roller 19. A metered quantity of glue is thereby received, each time, by glue faces of the glue-coating member 21 or of the glue wings 22, 23. Glue faces 32 directed transversely, that is to say extending essentially in the peripheral direction are formed as glue carriers on the outer ends of the glue wings 22, 23.

Figure 6:
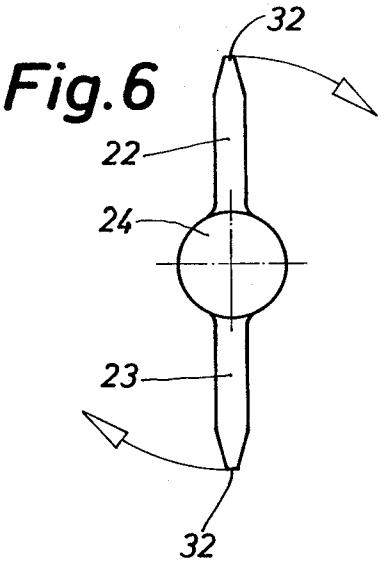
FIG. 6 shows a transverse view relative to FIG. 5.
Figure 5:
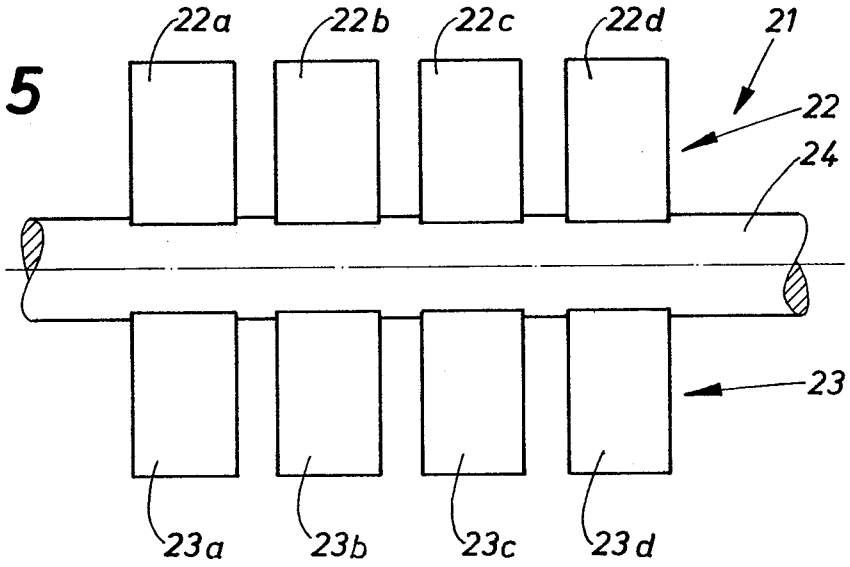
FIG. 5 shows a side view of a detail of the glue unit, in particular a glue-coating member.
Figure 8:
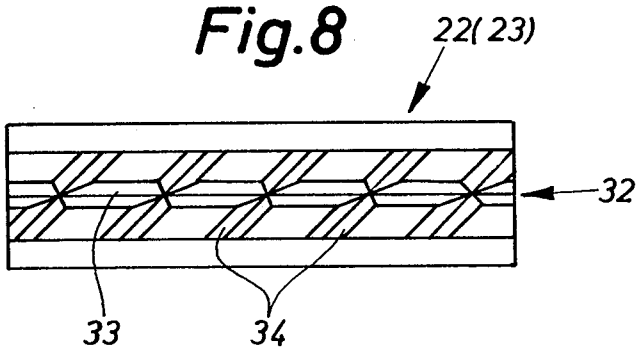
FIG. 8 shows a plan view of the glue face according to FIG. 7.
Figure 7:
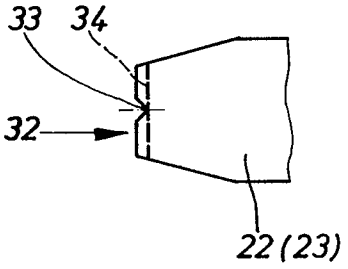
FIG. 7 shows a side view of a detail of a glue-coating member, in particular a glue face, on an enlarged scale.

The glue faces 32 are designed in a special way, so that they always receive a specific metered quantity of glue from the casing of the glue roller 19. As is evident from FIGS. 6 to 8, the radially outer end regions of the glue wings 22 and 23 are made convergent, that is to say with a decreasing width. The relatively narrow outer end faces form the glue faces 32. These are provided with elevations and depressions, the latter taking up glue. In the exemplary embodiment illustrated, the glue faces 32 are provided with V-shaped grooves 33 for taking up glue, specifically with a central longitudinal groove 33 and transverse grooves 34 arranged obliquely relative to this. These are arranged at an acute angle to the longitudinal groove 33. The longitudinal and transverse grooves are open at their ends. When the glue face 32 is moved past the outer surface of the glue roller at a slight distance from it, the longitudinal groove 33 and the transverse grooves 34 take up glue. Because of the design and arrangement of the grooves, when the glue is transferred onto the blank 10 an exact glue pattern is produced, in the present case a rectangle (glue mark 15) corresponding to the size of the glue face 32.

The present glue unit 16 is assigned to a folding turret 35 for producing soft-cup packs 11. The folding turret is preferably designed as illustrated and described in German Patent Application No. P 35 45 844.4. The folding turret 35 is accordingly equipped, along the periphery, with hollow bodies 36, so-called hollow mandrels, round which the blank 10 is folded. Assigned to the hollow bodies 36 are folding and holding members for folding and securing the blank 10 or the partially folded pack. In the region of a take-up station 37 formed in the upper region of the folding turret 35 rotating continuously in a vertical plane, the blank 10 is provided in a curved arcuate shape by a laterally arranged blank-holder 38 and is taken along by the hollow body 36. The blank 10 is thereby laid against the front side of the hollow body 36 and against the top and bottom of this. The side-wall tabs 13 and 14 pointing rearwards in the conveying direction project (initially) beyond the hollow body 36. The side-wall tab 13 for receiving the glue mark 15 is directed radially outwards. To fix the blank 10 in this position, each hollow body 36 has assigned to it a radially moveable, resiliently mounted retaining plate 38 which is moved up to the radially inner (larger) inner face of the hollow body 36, thereby fixing the blank 10.

As seen in the direction of rotation of the folding turret 35, the glue unit 16 is arranged fixed in place after the take-up station 37 and outside the path of movement of the folding turret 35. The relative position is such that, during rotation, the glue-coating member 21, or the glue wing 22, 23 or thereof enters the path of movement of the folding turret 35. To transfer the glue or to make the glue marks 15 on the freely projecting unsupported side-wall tab 13, the glue wing 22 or 23, as a result of coordinated relative movement in relation to the folding turret 35, is moved up against the radially outer face of the side-wall tab 13 in such a way that the latter is deformed elastically. The movement of the glue wing 22, 23 and that of the folding turret 35 are in the same direction during this phase. In the exemplary embodiment illustrated, the folding turret 35 rotates in the anti-clockwise direction and the glue wings 22, 23 rotate in the clockwise direction. As a result of the further movement of the side-wall tab 13 after the glue wing 22, 23 has come up against it, a rolling movement of the glue face 32 on the side-wall tab 13 is obtained. As result, a highly accurate glue pattern, in the present case rectangular glue marks 15, is transferred to the side-wall tab within the shortest time, that is to say at high speeds.

Figure 3:
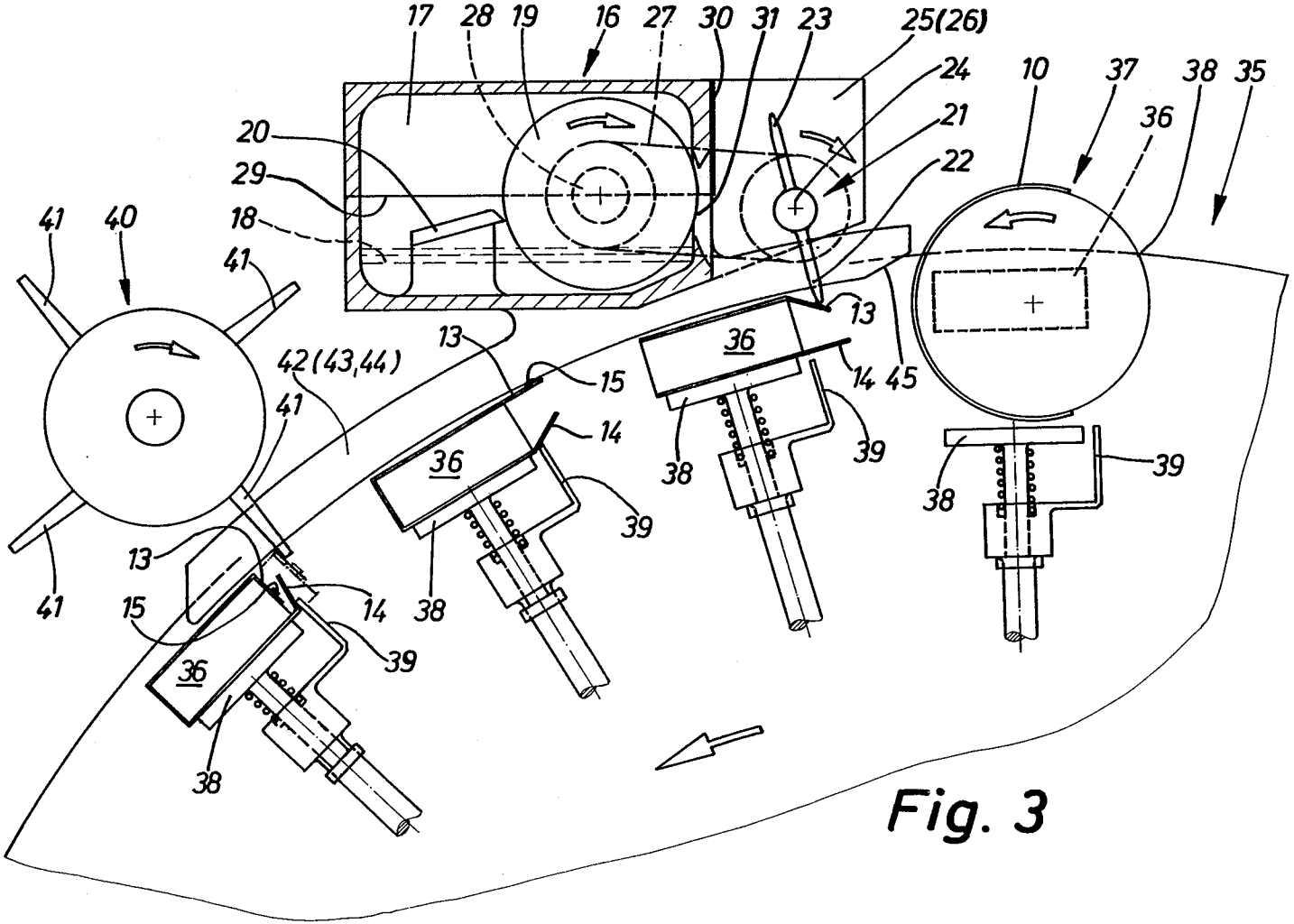
FIG. 3 shows, partially in vertical section, a cut-out of a folding turret with a glue unit.
Figure 4:
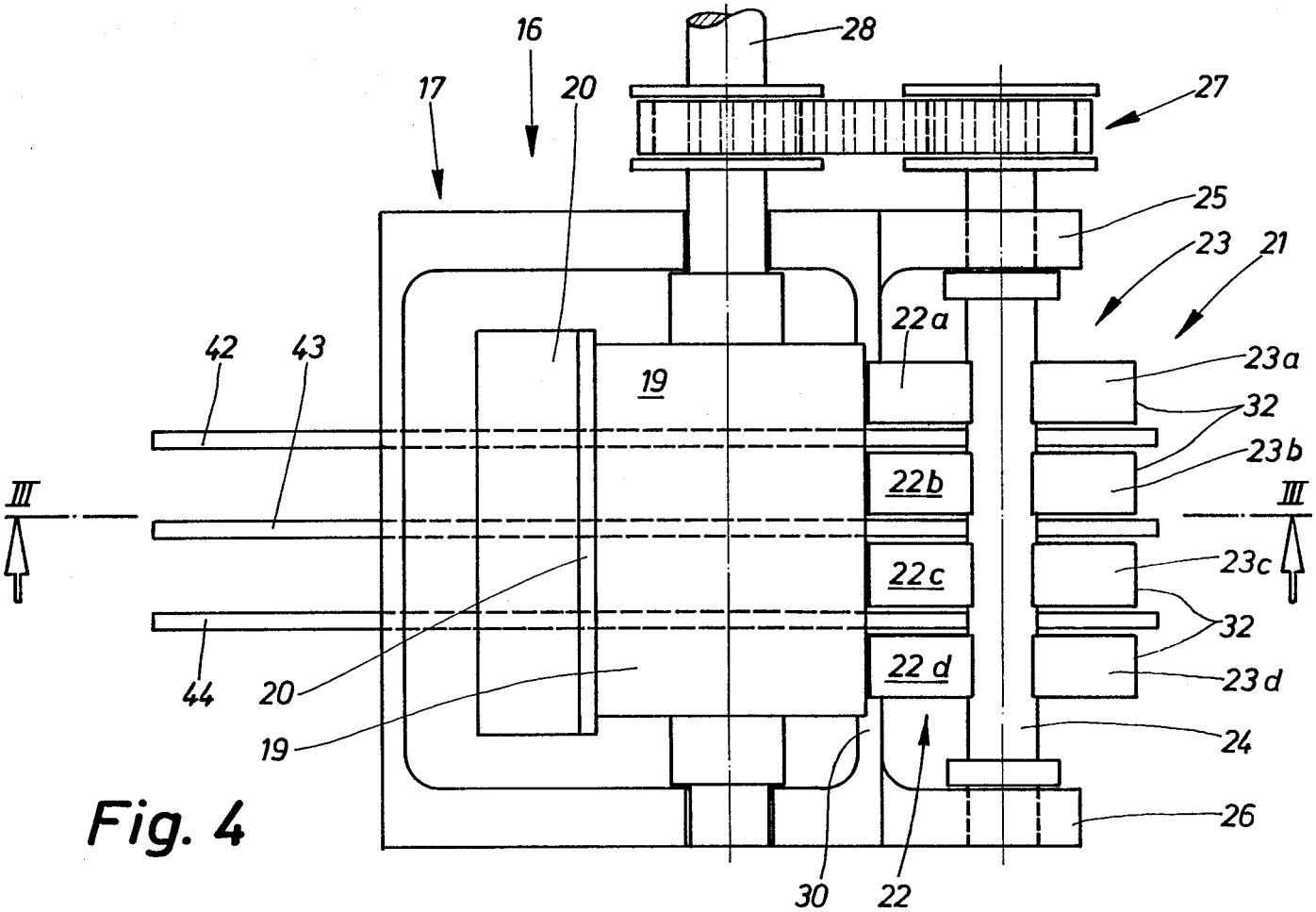
FIG. 4 shows a plan view of the glue unit of FIG. 3 on an enlarged scale.

The movements and dimensions of the members described are so coordinated with one another that the particular glue wing coming next is assigned to the next following hollow body 36 of the folding turret 35 and reaches the position shown in FIG. 3 with regard to the glue wing 22 when the folding turret has been moved further an appropriate amount. After the glue has been transferred, the particular glue wing 22 comes out of the region of the folding turret 35 and immediately thereafter up against the circumference of the glue roller 19.

The side-wall tab provided with the glue marks 15 returns to the rearward-directed position as a result of its material elasticity. A folding member 40 likewise mounted fixed in place outside the path of movement of the folding turret 35 and having radially projecting rotating folding fingers 41 enters with these the path of rotation of the folding turret 35 or of the hollow bodies 36, specifically in such a way that the rearward-pointing side-wall tab 13 having the glue marks 15 is grasped by a folding finger 41 outside the glue marks 15 and, as result of a higher speed than the hollow body 36, is folded round against the rearwardpointing narrow side face of the hollow body 36.

In the course of a longer stage of movement of the hollow body 36, the radially inner side-wall tab 14 is folded by a radially shiftable folding leg 39 rotating together with the folding turret 35. The course of this folding movement is coordinated with the folding movement of the side-wall tab 13 in such a way that the latter first rests against the hollow body 36, the radially inner side-wall tab 14 consequently being folded up against the glue marks 15.

Several vertical guide webs 42, 43, 44 located next to one another are arranged on the glue unit 16, in particular on its glue vessel 17. These are of arcuate shape to match the outer contour of the folding turret 35. The connection to the glue vessel 17 and consequently the relative position of these guide webs 42, 43, 44 is such that they extend along the periphery of the folding turret 35, after the take-up station 37, to beyond the folding member 40. At the same time, the guide webs 42, 43, 44 are arranged so that they guide and support the outer face of the blank 10 in this region. In the entry region, the guide webs 42, 43, 44 are provided with a run-in chamfer 45, by means of which, as result of the relative movement of the folding turret 35, the radially outer region of the blank 10, after being taken along by the hollow body 36, is pressed against the outer face of the latter.

To make it possible for the glue wings 22, 23 to execute the rotary movement described in spite of the stationary guide webs 42, 43, 44, each glue wing 22, 23 is subdivided into several, in particular four part wings *22a, 22b, 22c, 22d* and *23a, 23b, 23c, 23d*. These together form respectively a glue wing 22 and 23. During the rotary movements, the part wings *22a* to *23d* enter the gaps between the guide webs 42, 43, 44. Moreover, the part wings form separate rectangular glue faces 32 corresponding to the rectangular glue marks 15.

Otherwise, the further folding and completion of the soft-cup pack 11 take place in the way described in German Patent Application P 33 45 884.4.

We claim:

1. Apparatus for coating glue onto folding tabs of packaging blanks and having a glue unit including a rotating glue-coating member which transfers glue portions extracted from a glue vessel onto the packaging blank, wherein said glue-coating member (21) has at least one radially directed glue wing (22, 23) having an end face which serves as a glue face (32) which is movable up against a freely projecting, elastically deformable folding tab (13) and rolls on the folding tab while at the same time pivoting the folding tab (13) elastically; said apparatus comprising a rotating folding turret (35) which moves a blank (10) along an arc of a circle during contact of the folding tab by said glue face (32); and wherein the glue-coating member (21) is arranged outside the range of rotation of the folding turret (35) and adjacent to the periphery of the latter, so that a radially outer folding tab (13), pointing rearwards in the direction of rotation of the folding turret (35), is loaded with glue on the outside by the glue wing (22, 23) momentarily moved in the same direction.

2. Apparatus for coating glue onto folding tabs of packaging blanks and having a glue unit including a rotating glue-coating member which transfers glue portions extracted from a glue vessel onto the packaging blank, wherein said glue-coating member (21) has two radially oppositely directed glue wings (22, 23) each having an end face which serves as a glue face (32) which is movable up against a freely projecting, elastically deformable folding tab (13) and rolls on the folding tab while at the same time pivoting the folding tab (13) elastically; said apparatus comprising a rotating folding turret (35) which moves a blank (10) along an arc of a circle during contact of the folding tab by said glue face (32); wherein said rotating glue-coating member comprises a driven drive shaft (24) on which said two oppositely directed glue wings (22, 23) are arranged; said apparatus further comprising parallel arcuate guide webs (42, 43, 44) extending along the outer periphery of the folding turret (35) and connected to the glue vessel of glue unit.

3. Apparatus according to claim 2, wherein the guide webs (42, 43, 44) are also located in the region of the rotating glue wings (22, 23) which are subdivided into several part wings (*22a, 22b, 22c, 22d; 23a, 23b, 23c, 23d*) which move between the parallel guide webs (42, 43, 44).

4. Apparatus according to claim 2 or 3, wherein the glue-coating member (21) is arranged outside the range of rotation of the folding turret (35) and adjacent to the periphery of the latter, so that a radially outer folding tab (13), pointing rearwards in the direction of rotation of the folding turret (35), is loaded with glue on the outside by a glue wing (22, 23) momentarily moved in the same direction.

* * * * *